US006958099B2

(12) United States Patent
Nakamura et al.

(10) Patent No.: US 6,958,099 B2
(45) Date of Patent: Oct. 25, 2005

(54) HIGH TOUGHNESS STEEL MATERIAL AND METHOD OF PRODUCING STEEL PIPES USING SAME

(75) Inventors: Shigeru Nakamura, Wakayama (JP); Kaori Kawano, Neyagawa (JP); Tomohiko Omura, Kishiwada (JP); Toshiharu Abe, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 23 days.

(21) Appl. No.: 10/419,967

(22) Filed: Apr. 22, 2003

(65) Prior Publication Data

US 2003/0178111 A1 Sep. 25, 2003

Related U.S. Application Data

(63) Continuation of application No. PCT/JP01/10920, filed on Dec. 12, 2001.

(30) Foreign Application Priority Data

Aug. 2, 2001 (JP) ..... 2001-235349

(51) Int. Cl.[7] ..... C22C 38/12; C22C 38/22; C21D 8/10

(52) U.S. Cl. ..... 148/334; 148/328; 148/654; 148/663; 148/593

(58) Field of Search ..... 148/654, 663, 148/593, 334, 328

(56) References Cited

FOREIGN PATENT DOCUMENTS

| | | |
|---|---|---|
| JP | 58-224116 | 12/1983 |
| JP | 05-271772 | 10/1993 |
| JP | 06-172858 | 6/1994 |
| JP | 2000-017389 | 1/2000 |
| JP | 2000-178682 | 6/2000 |
| JP | 2000-256783 | 9/2000 |
| JP | 2000-297344 | 10/2000 |
| JP | 2001-073086 | 3/2001 |

*Primary Examiner*—Deborah Yee
(74) *Attorney, Agent, or Firm*—Clark & Brody

(57) ABSTRACT

A steel material and a steel pipe made by using the same are provided which are to be used in severe oil well environments. Such a highly tough oil well steel pipe can be produced by rolling the base material, quenching the rolling product from the austenite region and tempering the same so that the relationship between the content of Mo [Mo] in the carbides precipitated at austenite grain boundaries and the austenite grain size (according to ASTM E 112) can be defined by the formula (a) given below. In this manner, steel pipes suited for use even under oil well environments becoming more and more severe can be produced while satisfying the requirements that the cost should be rationalized, the productivity improved and energy saved.

$$[Mo] \leqq \exp(G-5)+5 \quad (a)$$

7 Claims, 1 Drawing Sheet

HIGH TOUGHNESS STEEL MATERIAL AND METHOD OF PRODUCING STEEL PIPES USING SAME

This application is a continuation of International Patent Application No. PCT/JP01/10920 filed Dec. 12 2001. This PCT application was not in English as published under PCT Article 21(2).

TECHNICAL FIELD

This invention relates to a steel material having a high level of toughness and suited for use in producing steel pipes to be used under severe conditions in oil well environments and to a method of producing steel pipes for oil wells using the same while rationalizing the cost, improving the productivity and, further, saving energy.

BACKGROUND ART

In recent years, the oil well drilling environment has become more and more severe, and steel pipes for oil wells used on each spot are now exposed to an oil well drilling environment containing carbon dioxide and the like in addition to the increasing depth of oil wells. The steel material to be used in producing such steel pipes is required to have strength and toughness characteristics. In particular, oil wells to be developed in the future are expected to be ones having a greater depth or horizontal ones and, therefore, the steel pipes to be used are required to have still higher strength and toughness performance characteristics than the levels so far required.

To cope with these requirements, the art has endeavored to produce high performance steel pipes by reducing the size of austenite grains in the steel material or by adding an expensive additive element or elements to thereby improve the hardenabihty. From such a viewpoint, Japanese Patent No. 2672441, for instance, proposes a method of producing seamless steel pipes characterized by high strength and high toughness.

According to the production method proposed in the above-cited patent specification, the austenite grain size is reduced to ASTM No. 9 or finer to thereby secure excellent resistance to sulfide stress corrosion cracking (SSCC resistance) as well as high strength and toughness performance characteristics.

Thus, the production method proposed in the above patent specification is intended to give steel species having high toughness and employs the so far known technique of reducing the size of austenite grains and, therefore, it is expected that the reduction in size of austenite grains will cause deterioration in hardenability. When the hardenability of a steel species becomes poor, the toughness and corrosion resistance will deteriorate. For preventing the hardenability of steel from deteriorating, it is generally necessary to add a large amount of such an expensive element or elements as Mo.

Furthermore, the production method proposed in the above-cited patent specification presupposes that direct quenching or in-line heat treatment be performed directly from the heated state after rolling, which is then followed by tempering. Therefore, the method requires strict control of rolling conditions and, in this respect, it is unsatisfactory for the cost rationalization and production efficiency viewpoint. The method still has the problem that the productivity improvement, energy saving and cost reduction currently required in the production of steel pipes for oil wells cannot be accomplished.

On the other hand, methods of producing steel pipes for oil wells capable of showing good performance characteristics in oil well environments even when the size of austenite grains is relatively coarse have been proposed. Since intragranular cracking serves as the origin of breakage with the increasing strength of steel, Japanese Patent Application Laid-open No. S58-224116, for instance, proposes a method of producing seamless steel pipes excellent in sulfide stress cracking resistance which comprises reducing the contents of P, S and Mn, adding Mo and Nb, and controlling the austenite grain size within the range of 4 to 8.5.

Further, Japanese Patent No. 2579094 proposes a method of producing oil well steel pipes having high strength and excellent sulfide stress corrosion cracking resistance which comprises adjusting the steel composition and hot rolling conditions to thereby adjust the austenite grain size to 6.3 to 7.3.

However, any of the methods so far proposed does not mention anything about the securing of toughness required of steel pipes for oil wells and cannot be employed as a method of producing oil well steel pipes having both high strength and high toughness.

Meanwhile, it is known that, for securing the toughness of steel materials, it is effective to strengthen the austenite grain boundaries themselves in place of reducing the austenite grain size. As a means therefor, a method is known which comprises controlling the carbides precipitating on austenite grain boundaries. Thus, grain boundaries, as compared with intragranular, are the places where carbides tends to readily precipitate and where carbides readily condense, so that the strength of grain boundaries itself tends to decrease.

Therefore, it becomes possible to improve the toughness of steel materials when coarse carbide precipitation and/or carbide condensation at austenite grain boundaries is prevented. For such reasons, high levels of toughness cannot be attained without controlling the carbides precipitating on grain boundaries when the austenite grains are relatively coarse as with the steel species disclosed in the above-cited Japanese Patent Application Laid-open No. S58-224116 and Japanese Patent No. 2579094.

From such viewpoints, methods of inhibiting the precipitation of carbides which tend to become coarse at austenite grain boundaries have recently attracted attention. Among carbides which may occur in low alloy steel species containing Cr and Mo, there are the types $M_3C$, $M_7C_3$, $M_{23}C_6$, $M_3C$ and MC. Among these, carbides of the $M_{23}C_6$ type are thermodynamically stable and readily precipitate and, at the same time, are coarse carbides, so that they decrease the toughness of steel materials. Further, $M_3C$ type carbides are acicular in shape and increase the stress concentration coefficient, hence decrease the SSCC resistance.

For the reasons mentioned above, methods have now been proposed for inhibiting the precipitation of $M_{23}C_6$ type and/or $M_3C$ type carbides. For example, Japanese Patent Application Laid-open No. 2000-178682, Japanese Patent Application Laid-open No. 2000-256783, Japanese Patent Application Laid-open No.2000-297344, Japanese Patent Application Laid-open No. 2000-17389 and Japanese Patent Application Laid-open No.2001-73086 disclose steel species or steel pipes with reduced contents of $M_{23}C_6$ type carbides. However, the methods disclosed in these publications pay attention only to the controlling of $M_{23}C_6$ type carbides but do not take into consideration the influences of the austenite grain size; therefore, it must be said that the hardenability of steel is sacrificed in them.

In other words, under the circumstances, none of the methods relying only on the technique of reducing the austenite grain size or only on the technique of controlling carbides tending to become coarse can accomplish the intended objects in producing steel species or steel pipes having high strength and high toughness and excellent sulfide stress corrosion cracking resistance (SSCC resistance) at low cost. Therefore, guidelines are desired for optimally combining and for making good use of both the effect of carbide control and the effect of reducing the austenite grain size so that steel species or steel pipes suited for use in oil well environments can be produced at low cost.

DISCLOSURE OF INVENTION

As mentioned hereinabove, when an attempt is made to increase the toughness only by the technique of reducing the size of austenite grains, the hardenability of steel materials decreases. Since when the hardenability decreases, the performance characteristics required of steel materials cannot be secured any longer, it becomes necessary to add an expensive element or elements to thereby make up the decrease in hardenability and secure the required performance characteristics. Therefore, the technique of reducing the austenite grain size, when employed alone, results in an increase in the content of expensive elements, hence, as a whole, in an increase in steel material production cost.

Furthermore, even when oil well steel pipes are produced using a steel material relatively coarse in grain size, it is difficult to secure a required level of toughness. For securing such toughness, it is effective to control carbides precipitating at grain boundaries and thereby strengthen the austenite grain boundaries themselves. However, when emphasis is placed only on the control of the morphology of carbides without paying any attention to the influences of the austenite grain size, the hardenability of steel materials will lower, with the result that no high toughness can be obtained.

Therefore, it is desired that some guidelines for optimally combining the effect of carbide control and the effect of reducing the size of austenite grains be provided and that oil well steel pipes having high toughness be developed by employing the guidelines.

It is an object of the present invention, made in view of the above problems, to provide a highly tough steel material suited for use in producing steel pipes to be used in oil well environments, which are expected to be more and more severe in the future, by using the above material as the starting material.

To accomplish the above object, the present inventors melted steel materials having various chemical compositions, varied the austenite grain size by varying the heat treatment conditions, and investigated the relationship between the behavior of precipitation of carbides at grain boundaries and the steel composition and, further, the relationship between these and the toughness performance.

As mentioned hereinabove, as the austenite grain size increases, the hardenability of the steel material increases but the precipitation of coarse carbides at austenite grain boundaries becomes facilitated and the toughness deteriorates with the precipitation of coarse carbides. While the toughness is improved when the austenite grain size decreases, further detailed investigations revealed, in addition to the above effect, that the precipitation of coarse carbides can be prevented by reducing the austenite grain boundaries. This is due to the increase in number of sites where carbides readily precipitate and the resulting dispersion of precipitation, leading to reduction in size of individual carbides. Furthermore, regarding the characteristics of carbides found at austenite grain boundaries, the inventors could obtain the following findings (1) to (4).

(1) Upon analysis of the composition of carbides precipitated at austenite grain boundaries, the main elements in the carbides were Fe, Cr, Mo and the like in addition to C. It was also confirmed that the carbides precipitated within granules are smaller than the carbides precipitated at austenite grain boundaries. Therefore, the composition of carbides precipitated within granules was examined and found that the carbides are almost free of Mo.

(2) While it is generally said that the shape (acicular or spherical) of carbides is determined by the tempering temperature, it was found that when the Mo content in carbides differs, the shape of carbides varies even at the same tempering temperature.

(3) In view of the above findings (1) and (2), the content of Mo in carbides was supposed to be a factor exerting influences on the morphology and size of carbides, and the composition of carbides precipitated at austenite grain boundaries was analyzed and, as a result, it was found that the Mo content in coarser carbides is higher and the Mo content in carbides smaller in size is lower. In other words, by decreasing the Mo content in carbides, it is possible to prevent the carbides precipitated at austenite grain boundaries from becoming coarse and thereby improve the toughness of steel materials.

(4) Furthermore, as the austenite grain size changes, the influence of the content of Mo in carbides on the coarsening of carbides varies. Therefore, by controlling the Mo content in carbides precipitated at grain boundaries according to the change in austenite grain size, it is possible to adequately prevent the precipitation of coarse carbides at austenite grain boundaries.

The present invention, which has been completed based on the above findings, consists in the steel materials specified below under (1) to (4) and a method of producing steel pipes as defined below under (5).

(1) A steel material having high toughness which is characterized in that the content of Mo [Mo] in the carbides precipitated at austenite grain boundaries satisfies the formula (a) given below:

$$[\mathrm{Mo}] \leqq \exp(G-5)+5 \quad \text{(a)}$$

where G is the austenite grain size number according to ASTM E 112.

(2) A steel material having high toughness which is characterized in that it contains, by mass %, C: 0.17–0.32%, Si: 0.1–0.5%, Mn: 0.30–2.0%, P: not more than 0.030%, S: not more than 0.010%, Cr: 0.10–1.50%, Mo: 0.01–0.80%, sol. Al: 0.001–0.100%, B: 0.0001–0.0020% and N: not more than 0.0070% and in that the content of Mo [Mo] further satisfies the above formula (a).

(3) Desirably, the steel material defined above under (2) further contains one or more of Ti: 0.005–0.04%, Nb: 0.005–0.04% and V: 0.03–0.30%.

(4) A steel material having high toughness which is characterized in that, as a more desirable chemical composition, it contains, by mass %, C: 0.20–0.28%, Si: 0.1–0.5%, Mn: 0.35–1.4%, P: not more than 0.015%, S: not more than 0.005%, Cr: 0.15–1.20%, Mo: 0.10–0.80%, sol. Al: 0.001–0.050%, B: 0.0001–0.0020% and N: not more than 0.0070% and further contains one or more of Ti: 0.005–0.04%, Nb: 0.005–0.04% and V: 0.03–0.30% and in that the content of Mo [Mo] in the carbides precipitated at austenite grain boundaries satisfied the formula (a) given above.

(5) A method of producing highly tough steel pipes for oil wells which comprises rolling a steel material containing the elements defined above under (2) to (4), quenching the same from the austenite region, wherein, after the subsequent tempering, the content of Mo [Mo] in the carbides precipitated at austenite grain boundaries satisfies the formula (a) given above.

BEST MODES FOR CARRYING OUT THE INVENTION

Figure 1:
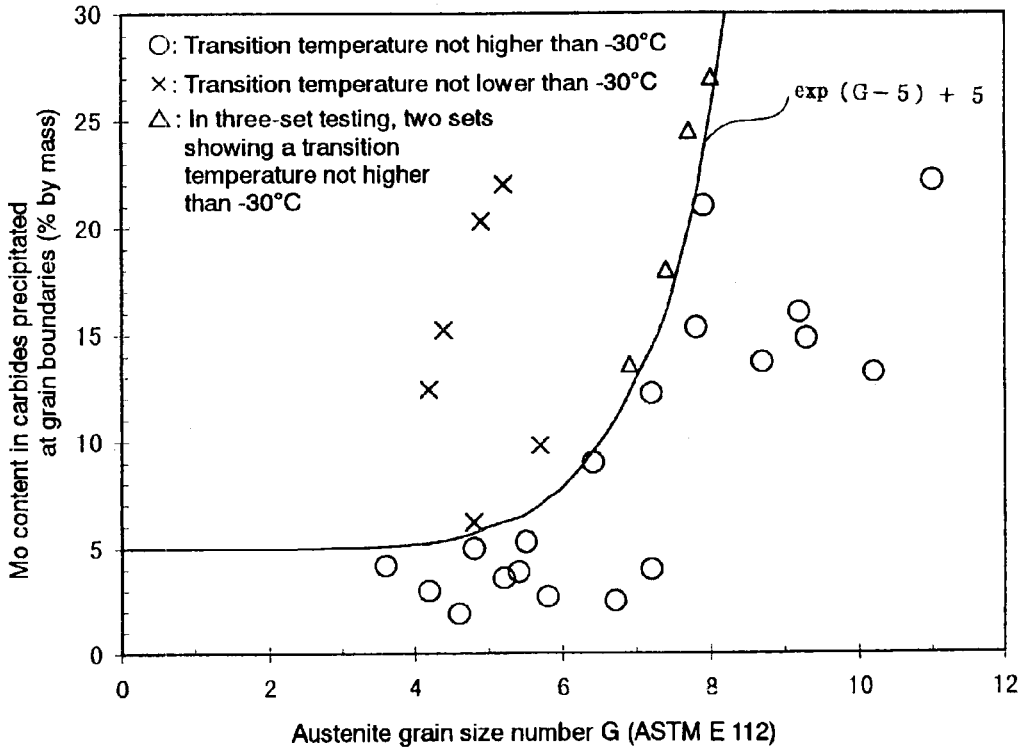
FIG. 1 is a representation of the relationship between the austenite grain size (according to ASTM E 112) and the content of Mo (% by mass) in the carbides precipitated at austenite grain boundaries.

The grounds for restriction of the Mo content in the carbides precipitated at austenite grain boundaries, the chemical composition of the steel and the method of production as specified above are explained below.

1. Mo Content in Carbides Precipitated at Austenite Grain Boundaries

For providing a steel material with high toughness as well as strength, the method is generally used which comprises reducing the austenite grain size and conducting quenching and tempering treatments. By reducing the austenite grain size, the impact force exerted on individual grain boundaries is dispersed and, as a whole, the toughness is improved. Thus, the reduction in austenite grain size does not serve to strengthen the austenite grain boundaries themselves but serves to reduce the grain boundary area perpendicular to the loading of direction of the impact force to thereby disperse the impact force and improve the toughness.

It is also possible to improve the toughness of steel materials by strengthening the austenite grain boundaries themselves. First, the grain boundaries can be strengthen by eliminating those elements which segregate at grain boundaries to thereby weaken the grain boundaries, for example P. For preventing the segregation of P, it is required to minimize the content of P. In connection with the cost of dephosphorization in steel making processes, steels are saturated with a certain content level of P.

Available as other means for strengthening the austenite grain boundaries themselves, there is the method comprising controlling the carbides precipitated at austenite grain boundaries. The effect of this method of grain boundary strengthening, if successful in effectively preventing carbides from becoming coarse, may be greater than the effect of the suppression of segregation of P in improving the toughness of steel materials.

Therefore, in the present invention, attention was paid to the fact that high toughness can be attained when the carbides which otherwise occur as coarse precipitates at austenite grain boundaries and weaken the grain boundaries are controlled. Thus, when coarse carbides precipitate or aggregates of carbides precipitate at austenite grain boundaries, the toughness is deteriorated but, when relatively small carbides precipitate dispersedly at austenite grain boundaries, the toughness is rather improved.

Then, the inventors paid their attention to the fact that by controlling the Mo content in the carbides precipitated at austenite grain boundaries to an optimum level, it becomes possible to obtain highly tough steel materials as a result. Thus, when the Mo content in the carbides precipitated at austenite grain boundaries is small, the coarsening of the carbides can be prevented whereas when the Mo content in the carbides is high, the coarsening of the carbides is promoted.

FIG. 1 shows the relationship between the austenite grain size (according to ASTM E 112) and the Mo content (% by mass) in the carbides precipitated at austenite grain boundaries. As the value of the austenite grain size number G increases, the austenite grain size decreases. The toughness characteristics are evaluated, for example, by testing Charpy test specimens according to ASTM A 370 as to whether they have characteristics such that they show a transition temperature of not higher than −30° C. When they satisfy the requirement that the transition temperature should be not higher than −30° C., they are evaluated as having high toughness. In each toughness evaluation, the test is carried out using a set of three test specimens as a unit.

As is evident from FIG. 1, high toughness regions which satisfy the transition temperature requirement of not higher than −30° C. can be caused to appear, even when the austenite grain size is coarse, by reducing the Mo content in the carbides precipitated at austenite grain boundaries. This means that by reducing the Mo content in the carbides precipitated at austenite grain boundaries, it is possible to prevent the carbides precipitated at austenite grain boundaries from becoming coarse or aggregating and, further, that the critical value of the Mo content, which affects the carbide morphology control and the toughness characteristics of steel materials, varies depending on the austenite grain size.

From the results shown in FIG. 1, it is seen that it is necessary for the Mo content [Mo] in carbides and the austenite grain size number G to satisfy the relation represented by the formula (a) given below.

$$[\mathrm{Mo}] \leqq \exp(G-5)+5 \quad \text{(a)}$$

The austenite grain size can be controlled mainly by selecting the quenching conditions and can further be controlled by adding one or more of Al, Ti and Nb. On the other hand, the factors controlling the Mo content in carbides consist in controlling the quenching conditions, tempering conditions and additive elements (in particular Mo). When the quenching conditions are varied, the degrees of redissolution and uniformity in dispersion of carbides vary and the content of Mo in carbides varies. When the tempering conditions are varied, the rates of diffusion of additive elements vary and, as a result, the Mo content in carbides varies. On the other hand, the content of Mo in carbides is greatly influenced by the additive elements, in particular the level of addition of Mo and other carbide-forming elements. For controlling the austenite grain size and the Mo content in carbides, it is thus necessary to adequately adjust the heat treatment conditions and the additive elements.

In the practice of the present invention, the Mo content in the carbides precipitated at austenite grain boundaries can be determined by combining the extraction replica method with an EDX (energy dispersive X-ray spectrometer). The "EDX" is a kind of fluorescent X-ray analyzer and depends on an electric spectroscopic method using a semiconductor detector.

In the present invention, the Mo content in the carbides precipitated at austenite grain boundaries was determined by observing austenite grain boundaries in five arbitrarily selected views at a magnification of 2,000, selecting three large carbides in each view and taking the mean value of the 15 values in total as the Mo content in the carbides.

2. Chemical Composition

In the following, the chemical composition effective for the steel material of the present invention is described. The chemical composition referred to herein is based on percentage by mass.

C: 0.17–0.32%

C is contained for the purpose of securing the strength of the steel material. However, when its content is less than 0.17%, the hardenability is unsatisfactory and the required strength can hardly be secured. For securing the hardenability, it becomes necessary to add an expensive additive(s) in large amounts. When its content exceeds 0.32%, hardening cracks may occur and, at the same time, the toughness deteriorates. Therefore, the C content should be 0.17% to 0.32%, desirable 0.20% to 0.28%.

Si: 0.1–0.5%

Si is an element effective as a deoxidizing element and at the same time contributes to an increase in resistance to temper softening and thus to an increase in strength. For the production of its effect as a deoxidizing element, the content of not less than 0.1% is necessary while, when its content exceeds 0.5%, the hot workability becomes markedly poor. Therefore, the Si content of 0.1–0.5% was selected.

Mn: 0.30–2.0%

Mn is a component which improves the hardenability of steel and secures the strength of steel materials. However, at a content below 0.30%, the hardenability is insufficient and both the strength and toughness decrease. Conversely, at a content exceeding 2.0%, the segregation in the direction of thickness of steel materials is promoted and, accordingly, the toughness decreases. Therefore, the Mn content should be 0.30–2.0%, desirably 0.35–1.4%.

P: Not more than 0.030%

While it is required to minimize the content of P so that the grain boundaries may be strengthened, P is unavoidably present in steel as an impurity. Although processes for dephosphorization have so far been developed and improved, a prolonged time is required therefor for reducing the P content and therefore the temperature of the molten steel lowers, making the subsequent process operation difficult. Therefore, it is allowed to be contained at a certain saturation level. At a P content exceeding 0.030%, however, it segregates at grain boundaries and causes a degrease in toughness. Therefore, its content should be not more than 0.030%, desirably not more than 0.015%.

S: Not more than 0.010%

S occurs unavoidably in steel and binds to Mn or Ca to form such inclusions as MnS or CaS. These inclusions are elongated in the step of hot rolling and thereby take an acicular shape, facilitating stress concentration and thus adversely affecting the toughness. Therefore, the S content should be not more than 0.01%, desirably not more than 0.005%.

Cr: 0.10–1.50%

Cr is an element improving the hardenability and at the same time effective in protecting carbon dioxide gas corrosion in carbon dioxide-containing environments. However, its addition in excessive amounts facilitates the formation of coarse carbides. Therefore, the upper limit to its content is set at 1.50%. From the viewpoint of preventing the formation of coarse carbides, the upper limit of 1.20% is desirable. On the other hand, for the effect of adding Cr to be produced, the lower limit to its content is set at 0.10%, more desirably at 0.15%.

Mo: 0.01–0.80%

Mo is effective in controlling the precipitation morphology of carbides appearing at austenite grain boundaries and is a useful element in obtaining highly tough steel materials. Furthermore, it is also effective in increasing the hardenability and preventing the grain boundary embrittlement due to P. For making it to produce these effects, its content should be within the range of 0.01–0.80%. Amore desirable content is 0.10–0.80%.

Sol. Al: 0.001–0.100%

Al is an element necessary for deoxidation. When the content of sol. Al is below 0.001%, insufficient deoxidation results, deteriorating the steel quality and decreasing the toughness. Conversely, when the content is excessive, a decrease in toughness may rather be caused. Therefore, the upper limit is set at 0.100%, desirably at 0.050%.

B: 0.0001–0.0020%

The addition of B can result in a marked improvement in hardenability and, therefore, the level of addition of expensive alloying elements can be reduced. In particular, even in the case of producing thick-walled steel pipes, the target strength can readily be secured by adding B. However, when its content is below 0.0001%, these effects cannot be produced and, conversely, at levels exceeding 0.0020%, the precipitation of carbonitrides at grain boundaries becomes easy, causing toughness deterioration. Therefore, the B content should be 0.0001–0.0020%.

N: Not more than 0.0070%

N is unavoidably present in steel and binds to Al, Ti or Nb to form nitrides. In particular when AlN or TiN precipitates in large amounts, the toughness is adversely affected. Therefore, its content should be not more than 0.0070%.

Ti: 0.005–0.04%

It is not necessary to add Ti. When added, it forms the nitride TiN and is thus effective in preventing grain coarsening in high temperature ranges. For attaining this effect, it is added at a level not lower than 0.005%. However, when its content exceeds 0.04%, the amount of TiC formed upon its binding to C increases, whereby the toughness is adversely affected. Therefore, when Ti is added, its content should be not more than 0.04%.

Nb: 0.005–0.04%

It is not necessary to add Nb. When added, it forms the carbide and nitride NbC and NbN and is effective in preventing grain coarsening in high temperature ranges. For attaining this effect, it is added at a level of not lower than 0.005%. However, at an excessive addition level, it causes segregation and elongated grains. Therefore, its addition level should be not more than 0.04%.

V: 0.03–0.30%

It is not always necessary to add V. When added, it forms the carbide VC and contributes to increasing the strength of steel materials. For attaining this effect, it is added at a level not lower than 0.03%. However, when its content exceeds 0.30%, the toughness is adversely affected. Therefore, its content should be not more than 0.30%.

3. Production Method

The production method of the present invention employs the process comprising rolling a steel material having the above chemical composition as a base material, quenching from the austenite region and then tempering, so that the Mo content [Mo] in the carbides precipitated at austenite grain boundaries may satisfy the above formula (a). The steps of quenching and tempering to be employed here may comprise either an in-line heat treatment process or an off-line heat treatment process.

In the in-line heat treatment process, following rolling, soaking within the temperature range of 900° C. to 1,000° C. and water quenching are carried out so that the austenitic state may be maintained, or, after rolling, water quenching is carried out in the austenitic state, followed by tempering under conditions such that the steel material acquires the required strength, for example a yield strength of about 758 MPa.

In the off-line heat treatment process, the steel pipe after rolling is once cooled to ordinary temperature with air and then again heated in a quenching furnace and, after soaking within the temperature range of 900° C. to 1,000° C., subjected to water quenching and thereafter to tempering under conditions such that the steel material acquires the required strength, for example a yield strength of about 758 MPa.

EXAMPLES

For confirming the effects of the steel materials according to the present invention, 13 steel species specified below in Table 1 were prepared. All the steel species satisfied the chemical composition ranges specified hereinabove.

Billets with an outside diameter of 225 mm were produced from each of the above steel species, heated to 1,250° C. and made into seamless steel pipes with an outside diameter of 244.5 mm and a wall thickness of 13.8 mm by the Mannesmann mandrel method. Each steel pipe manufactured was then subjected to an in-line or off-line heat treatment process.

In the in-line heat treatment process, for maintaining the austenitic state, each piper after rolling for pipe manufacture was subjected to soaking under various temperature conditions and to water quenching and then to 30 minutes of soaking, for tempering treatment, at a temperature such that the steel pipe might acquire a yield strength of about 758 MPa. Prior to quenching, the temperature for maintaining the austenitic state was varied within the range of 900° C. to 980° C. to evaluate the effect of the austenite grain size.

In the off-line heat treatment process, after pipe-forming rolling under the same conditions, each steel pipe was once air-cooled to ordinary temperature, then again heated in a quenching furnace and, after soaking under various temperature conditions, subjected to quenching and the subsequent 30 minutes of tempering treatment at a temperature adequate for attaining a yield strength of about 758 MPa. In the off-line heat treatment process, too, the temperature for maintaining the austenitic state prior to quenching was varied within the range of 900° C. to 980° C. For obtaining a still finer austenite grain size, the quenching and tempering were repeated twice.

TABLE 1

| Steel species | C | Si | Mn | S | P | Cr | Mo | Ti | V | Nb | sol. Al | B | N |
|---|---|---|---|---|---|---|---|---|---|---|---|---|---|
| A | 0.25 | 0.30 | 0.50 | 0.004 | 0.009 | 1.01 | 0.13 | 0.025 | — | 0.025 | 0.026 | 0.0013 | 0.0046 |
| B | 0.26 | 0.29 | 0.50 | 0.002 | 0.018 | 1.02 | 0.50 | 0.022 | — | 0.026 | 0.028 | 0.0010 | 0.0045 |
| C | 0.26 | 0.31 | 0.45 | 0.001 | 0.013 | 1.02 | 0.71 | 0.017 | 0.09 | 0.020 | 0.036 | 0.0015 | 0.0039 |
| D | 0.27 | 0.30 | 0.44 | 0.003 | 0.015 | 1.00 | 0.71 | 0.012 | — | 0.024 | 0.030 | 0.0011 | 0.0035 |
| E | 0.26 | 0.29 | 0.48 | 0.004 | 0.012 | 0.50 | 0.20 | 0.011 | — | — | 0.032 | 0.0011 | 0.0051 |
| F | 0.26 | 0.31 | 0.45 | 0.007 | 0.013 | 0.49 | 0.49 | 0.022 | — | 0.025 | 0.036 | 0.0015 | 0.0039 |
| G | 0.27 | 0.25 | 0.49 | 0.004 | 0.011 | 0.50 | 0.72 | 0.020 | — | 0.024 | 0.038 | 0.0012 | 0.0043 |
| H | 0.23 | 0.30 | 1.32 | 0.006 | 0.023 | 0.20 | 0.70 | 0.010 | — | — | 0.029 | 0.0001 | 0.0041 |
| I | 0.27 | 0.36 | 0.61 | 0.002 | 0.015 | 0.61 | 0.30 | 0.014 | 0.06 | — | 0.032 | 0.0013 | 0.0041 |
| J | 0.20 | 0.46 | 1.48 | 0.006 | 0.020 | 0.56 | 0.10 | — | — | — | 0.016 | 0.0002 | 0.0047 |
| K | 0.29 | 0.12 | 0.42 | 0.003 | 0.015 | 0.60 | 0.32 | 0.038 | — | 0.020 | 0.042 | 0.0008 | 0.0040 |
| L | 0.25 | 0.33 | 0.47 | 0.006 | 0.013 | 1.28 | 0.76 | 0.006 | 0.28 | 0.012 | 0.030 | 0.0009 | 0.0058 |
| M | 0.23 | 0.46 | 0.60 | 0.005 | 0.020 | 1.01 | 0.26 | — | — | 0.040 | 0.032 | 0.0001 | 0.0030 |

(The balance being Fe and unavoidable impurities)

Curved tensile test specimens defined in the API standard, 5CT, and full-size Charpy test specimens defined in ASTM A 370 were taken, in the lengthwise direction, from each steel tube after the above mentioned heat treatment process, and subjected to tensile testing and Charpy impact testing, and the yield strength (MPa) and fracture appearance transition temperature (° C.) were measured.

At the same time, test specimens for grain size measurement and test specimens for microscopic observation were taken, and the austenite grain size (grain size number defined in ASTM E 112) was measured and the Mo content in the carbides precipitated at austenite grain boundaries was determined by the combined use of the extraction replica method and an EDX. The results thus obtained are shown below in Table 2. The Charpy impact test was carried out on the three-set unit basis.

As is evident from the results shown in Table 2, the toughness is not affected when the austenite grain size is small, even when the Mo content in the carbides precipitated at austenite grain boundaries is rather high. As the austenite grain size increases, however, the toughness deteriorates with the increase in the Mo content in the carbides precipitated at grain boundaries. As mentioned above, this is due to the fact that the carbides tend to become coarse as the Mo content in the carbides precipitated at grain boundaries increases, whereby the austenite grain boundaries become embrittled.

The in-line heat treatment process, which is energy-saving and high in productivity, tends to allow an increase in austenite grain size as compared with the off-line heat treatment process. Therefore, it is difficult to satisfy the high toughness requirement by employing the in-line heat treatment process in the conventional methods. On the contrary, however, by controlling the Mo content in the carbides precipitated at austenite grain boundaries according to the present invention, it is possible to attain high toughness even when the in-line heat treatment process is employed.

In cases where the off-line heat treatment process is employed, it is of course possible to attain high toughness relatively easily even when the austenite grain size is increased to improve the hardenability.

TABLE 2

| | Austenite grain size | Mo content in carbides [Mo] (% by mass) | Toughness evaluation* | Yield strength (Mpa) | Steel species | Value of right member of formula (a) | Heat treatment process |
|---|---|---|---|---|---|---|---|
| Examples according to the invention | 3.6 | 4.3 | G | 728 | J | 5.25 | In-line |
| | 4.2 | 3.0 | G | 778 | E | 5.45 | In-tine |
| | 4.6 | 2.0 | G | 723 | A | 5.67 | Off-line |
| | 4.8 | 5.2 | G | 750 | E | 5.82 | In-line |
| | 5.2 | 3.5 | G | 743 | I | 6.22 | Off-line |
| | 5.4 | 4.0 | G | 703 | A | 6.49 | In-line |
| | 5.5 | 5.3 | G | 762 | I | 6.65 | In-line |
| | 5.8 | 2.7 | G | 763 | I | 7.23 | Off-line |
| | 6.5 | 8.9 | G | 733 | M | 9.48 | In-line |
| | 6.7 | 2.5 | G | 755 | E | 10.47 | Off-line |
| | 7.2 | 4.0 | G | 755 | A | 14.03 | Off-line |
| | 7.2 | 12.4 | G | 721 | C | 14.03 | Off-line |
| | 7.8 | 15.2 | G | 756 | H | 21.44 | Off-line |
| | 8.0 | 21.0 | G | 723 | K | 25.09 | Off-line |
| | 8.8 | 13.5 | G | 803 | F | 49.70 | Off-line |
| | 9.2 | 16.0 | G | 791 | G | 71.69 | Off-line |
| | 9.3 | 14.9 | G | 753 | D | 78.70 | Off-line |
| | 10.2 | 13.3 | G | 782 | B | 186.27 | Off-line |
| | 11.0 | 22.2 | G | 747 | L | 408.43 | Off-line |
| Comparative examples | 4.3 | 12.3 | F | 789 | C | 5.50 | In-line |
| | 4.5 | 15.2 | F | 791 | D | 5.61 | Off-line |
| | 4.8 | 6.4 | F | 802 | F | 5.82 | In-line |
| | 5.0 | 20.4 | F | 778 | G | 6.00 | In-line |
| | 5.3 | 22.0 | F | 709 | D | 6.35 | Off-line |
| | 5.7 | 9.6 | F | 751 | G | 7.01 | In-line |
| | 7.0 | 13.5 | N | 778 | F | 12.39 | Off-line |
| | 7.5 | 18.2 | N | 755 | K | 17.18 | Off-line |
| | 7.8 | 24.5 | N | 789 | B | 21.44 | Off-line |
| | 8.0 | 27.1 | N | 739 | L | 25.09 | Off-line |

*Toughness evaluations were made according to the following criteria:
G: In the three-set testing, all the three sets showed a transition temperature of not higher than −30° C.
F: In the three-set testing, all the three or two sets showed a transition temperature of not lower than −30° C.
N: In the three-set testing, one set showed a transition temperature of not lower than −30° C. and the remaining two sets showed a transition temperature of not higher than −30° C.

As is evident from the results given above, the method of producing steel pipes according to the present invention makes it possible to produce, with high efficiency, those highly tough steel pipes for oil wells which are to be used under oil well environments expected to become more and more severe in the future, while satisfying the requirements that the cost should be rationalized, the productivity improved and energy saved.

Industrial Applicability

The steel material according to the invention and the method of producing steel pipes using the same make it possible to manufacture highly tough steel pipes for oil wells by rolling the base material, tempering the same from the austenite region and tempering the same while controlling the relationship between the Mo content (% by mass) in the carbides precipitated at austenite grain boundaries and the austenite grain size (according to ASTM E 112). Steel pipes suited for use under oil well environments becoming more and more severe can thus be produced while satisfying the requirements that the cost should be rationalized, the productivity improved and energy saved. Therefore, the steel pipes can be used widely as products for use in oil and gas well drilling.

What is claimed is:

1. A steel material having high toughness comprising molybdenum and carbides precipitated at austenite grain boundaries, a content of Mo [Mo] in the carbides satisfying the formula (a) given below:

$$[\mathrm{Mo}] \leqq \exp(G-5)+5 \quad \text{(a)}$$

where G is the austenite grain size number according to ASTM E 112.

2. A steel material having high toughness comprising by mass %, C: 0.17–0.32%, Si: 0.1–0.5%, Mn: 0.30–2.0%, P: not more than 0.030%, S: not more than 0.010%, Cr: 0.10–1.50%, Mo: 0.01–0.80%, sol. Al: 0.001–0.100%, B: 0.0001–0.0020% and N: not more than 0.0070%, the balance being Fe and unavoidable impurities, the steel including carbides precipitated at austenite grain boundaries; and a content of Mo [Mo] in the carbides satisfying the formula (a) given below:

$$[\mathrm{Mo}] \leqq \exp(G-5)+5 \quad \text{(a)}$$

where G is the austenite grain size number according to ASTM E 112.

3. A steel material having high toughness comprising by mass %, C: 0.17–0.32%, Si: 0.1–0.5%, Mn: 0.30–2.0%, P: not more than 0.030%, S: not more than 0.010%, Cr: 0.10–1.50%, Mo: 0.01–0.80%, sol. Al: 0.001–0.100%, B: 0.0001–0.0020% and N: not more than 0.0070% and further containing one or more of Ti: 0.005–0.04%, Nb: 0.005–0.04% and V: 0.03–0.30%, the balance being Fe and unavoidable impurities, the steel including carbides precipitated at austenite grain boundaries; and a content of Mo [Mo] in the carbides satisfying the formula (a) given below:

$$[Mo] \leqq \exp(G-5)+5 \quad (a)$$

where G is the austenite grain size number according to ASTM E 112.

4. A steel material having high toughness comprising by mass %, C: 0.20–0.28%, Si: 0.1–0.5%, Mn: 0.35–1.4%, P: not more than 0.015%, S: not more than 0.005%, Cr: 0.15–1.20%, Mo: 0.10–0.80%, sol. Al: 0.001–0.050%, B: 0.0001–0.0020% and N: not more than 0.0070% and further containing one or more of Ti: 0.005–0.04%, Nb: 0.005–0.04% and V: 0,03–0.30%, the balance being Fe and unavoidable impurities, the steel including carbides precipitated at austenite grain boundaries; and a content of Mo [Mo] in the carbides satisfying the formula (a) given below:

$$[Mo] \leqq \exp(G-5)+5 \quad (a)$$

where G is the austenite grain size number according to ASTM E 112.

5. A method of producing highly tough steel pipes for oil wells, comprising hot rolling a steel which contains, by mass %, C: 0.17–0.32%, Si: 0.1–0.5%, Mn: 0.30–2.0%, P: not more than 0.030%, S: not more than 0.010%, Cr: 0.10–1.50%, Mo: 0.01–0.80%, sol. Al: 0.001–0.100%, B: 0.0001–0.0020% and N: not more than 0.0070%, the balance being Fe and unavoidable impurities, the steel including carbides precipitated at austenite grain boundaries; and quenching the hot rolled product from the austenite region, wherein, after the subsequent tempering, a content of Mo [Mo] in the carbides satisfies the formula (a) given below:

$$[Mo] \leqq \exp(G-5)+5 \quad (a)$$

where G is the austenite grain size number according to ASTM E 112.

6. A method of producing highly tough steel pipes for oil wells, comprising hot rolling a steel which contains, by mass %, C: 0.17–0.32%, Si: 0.1–0.5%, Mn: 0.30–2.0%, P: not more than 0.030%, S: not more than 0.010%, Cr: 0.10–1.50%, Mo: 0.01–0.80%, sol. Al: 0.001–0.100%, B: 0.0001–0.0020% and N: not more than 0.0070% and further containing one or more of Ti: 0.005–0.04%, Nb: 0.005–0.04% and V: 0.03–0.30%, the balance being Fe and unavoidable impurities, the steel including carbides precipitated at austenite grain boundaries; and quenching the hot rolled product from the austenite region, wherein, after the subsequent tempering, a content of Mo [Mo] in the carbides satisfies the formula (a) given below:

$$[Mo] \leqq \exp(G-5)+5 \quad (a)$$

where G is the austenite grain size number according to ASTM E 112.

7. A method of producing highly tough steel pipes for oil wells, comprising hot rolling a steel which contains, by mass %, C: 0.20–0.28%, Si: 0.1–0.5%, Mn: 0.35–1.4%, P: not more than 0.015%, S: not more than 0.005%, Cr: 0.15–1.20%, Mo: 0.10–0.80%, sol. Al: 0.001–0.050%, B: 0.0001–0.0020% and N: not more than 0.0070% and further containing one or more of Ti: 0.005–0.04%, Nb: 0.005–0.04% and V: 0.03–0.30%, the balance being Fe and unavoidable impurities, the steel including carbides precipitated at austenite grain boundaries; and quenching the hot rolled product from the austenite region, wherein, after the subsequent tempering, a content of Mo [Mo] in the carbides satisfies the formula (a) given below:

$$[Mo] \leqq \exp(G-5)+5 \quad (a)$$

where G is the austenite grain size number according to ASTM E 112.

* * * * *